US008151712B2

(12) United States Patent
Salignon et al.

(10) Patent No.: US 8,151,712 B2
(45) Date of Patent: Apr. 10, 2012

(54) PROJECTILE IN PARTICULAR AN ANTI-INFRASTRUCTURE PENETRATING BOMB AND METHOD FOR PENETRATION OF SAID PROJECTILE THROUGH A WALL

(75) Inventors: Denis Salignon, Orleans (FR); Claude Georget, Saint Denis En Val (FR); Dominique Lesne, Orleans (FR)

(73) Assignee: TDA Armements S.A.S. (FR)

( * ) Notice: Subject to any disclaimer, the term of this patent is extended or adjusted under 35 U.S.C. 154(b) by 668 days.

(21) Appl. No.: 11/628,859

(22) PCT Filed: May 31, 2005

(86) PCT No.: PCT/EP2005/052483

§ 371 (c)(1),
(2), (4) Date: Sep. 5, 2007

(87) PCT Pub. No.: WO2005/124270

PCT Pub. Date: Dec. 29, 2005

(65) Prior Publication Data

US 2008/0072782 A1 Mar. 27, 2008

(30) Foreign Application Priority Data

Jun. 8, 2004 (FR) ..... 04 06184

(51) Int. Cl.
*F42B 14/06* (2006.01)

(52) U.S. Cl. ..... 102/522; 102/521; 102/489

(58) Field of Classification Search ..... 102/503, 102/200, 202.5, 518, 489, 490, 473, 520, 102/521, 522, 523

See application file for complete search history.

(56) References Cited

U.S. PATENT DOCUMENTS

| | | | | | |
|---|---|---|---|---|---|
| 3,740,837 | A | * | 6/1973 | Robinson, Jr. | 29/602.1 |
| 3,754,507 | A | * | 8/1973 | Dillinger et al. | 102/374 |
| 3,961,580 | A | * | 6/1976 | Burnett et al. | 102/520 |
| 4,375,192 | A | | 3/1983 | Yates et al. | |
| 4,497,253 | A | * | 2/1985 | Sabranski | 102/476 |
| 4,586,436 | A | | 5/1986 | Denney et al. | |
| 4,597,333 | A | * | 7/1986 | Bocker et al. | 102/518 |
| 4,697,525 | A | * | 10/1987 | Bocker et al. | 102/518 |
| 4,706,569 | A | * | 11/1987 | Wallow et al. | 102/518 |
| 4,823,700 | A | * | 4/1989 | Alker et al. | 102/476 |
| 4,932,326 | A | | 6/1990 | Ladriere | |
| 5,189,248 | A | | 2/1993 | Deffayet et al. | |
| 5,656,792 | A | * | 8/1997 | Rentzsch et al. | 102/489 |

(Continued)

FOREIGN PATENT DOCUMENTS

FR 865939 6/1941

(Continued)

*Primary Examiner* — Michael Carone
*Assistant Examiner* — Jonathan C Weber
(74) *Attorney, Agent, or Firm* — Lowe Hauptman Ham & Berner, LLP

(57) ABSTRACT

This invention relates to a penetrating projectile, particularly an anti-infrastructure penetration bomb. The invention also relates to a penetration method applied to the above mentioned projectile. The penetrating projectile includes an inner tube inside which a perforating projectile is placed comprising at least one body provided with a pyrotechnic charge and a propulsion body, the body of the perforating projectile being ejected outside the tube by firing the propulsion body; and a system for controlling firing of the propulsion body before the impact of the penetrating projectile on a target. The invention is particularly applicable for passing through very thick walls made of a non-metallic material for example such as concrete.

16 Claims, 7 Drawing Sheets

U.S. PATENT DOCUMENTS

| | | | | |
|---|---|---|---|---|
| 6,053,109 | A | 4/2000 | Rüdenauer | |
| 6,276,277 | B1 * | 8/2001 | Schmacker | 102/384 |
| 6,647,889 | B1 * | 11/2003 | Biserød | 102/489 |
| 6,672,218 | B2 * | 1/2004 | Oechslin et al. | 102/374 |
| 6,845,718 | B2 * | 1/2005 | Fortner et al. | 102/518 |

FOREIGN PATENT DOCUMENTS

| | | |
|---|---|---|
| FR | 2274016 | 1/1976 |
| FR | 2472168 | 6/1981 |
| GB | 2350172 | 11/2000 |

* cited by examiner

PROJECTILE IN PARTICULAR AN ANTI-INFRASTRUCTURE PENETRATING BOMB AND METHOD FOR PENETRATION OF SAID PROJECTILE THROUGH A WALL

CROSS-REFERENCE TO RELATED APPLICATIONS

The present Application is based on International Application No. PCT/EP2005/052483, filed on May 31, 2005, which in turn corresponds to French Application No. 04 06184 filed on Jun. 8, 2004, and priority is hereby claimed under 35 USC §119 based on these applications. Each of these applications are hereby incorporated by reference in their entirety into the present application.

FIELD OF THE INVENTION

This invention relates to a penetrating projectile, particularly an anti-infrastructure penetration bomb. It is particularly applicable for passing through very thick walls made of a non-metallic material for example such as concrete. The invention is more particularly applicable to a penetration method applied to the above mentioned projectile.

BACKGROUND OF THE INVENTION

It is known that bombs with a high penetration capacity can be made to pass through concrete walls with a high modulus of rupture in compression. The thickness of such walls may be as high as 1.5 meters or even more. The modulus of rupture in compression may be of the order of 40 to 45 MPa, and values of the modulus of rupture in compression in recent concretes can be much higher than 100 MPa. Operational needs for passing through concrete walls can lead to increasingly high performance levels for penetration bombs. In particular, it may be required for them to pass through increasingly thick concrete walls with increasingly high values of the modulus of rupture in compression. Conventionally, the penetration capacity of a bomb depends on its kinetic energy. The result is that penetration difficulties increase with increased thickness of concrete and/or particularly its strength, consequently it is logical to increase the kinetic energy of the bomb, for example by varying its mass or its velocity. However, these magnitudes cannot be increased indefinitely.

A bomb is transported by a rocket to reach its objective. A rocket comprises essentially three parts. At the front it contains its guidance system and it has an engine at the back for propulsion. The warhead, in other words essentially the bomb, is located between these two elements. The dimensions, weight and velocity of rockets are fixed for versatility reasons, and for standardisation of launch ramps or standardisation of firing stations. The result is that the volume, weight and velocity of the bomb are also fixed regardless of the required performances. In particular, the kinetic energy cannot be increased so as to achieve new even higher performances. One solution could be to reinforce the structural strength of the bomb body, for example by tripling its thickness. Another solution could be to use a dense material with a significant reduction in the diameter. However, these solutions have disadvantages. The first solution makes it impossible to make a bomb body that is versatile to handle different surface or underground threats. The second solution results in a very expensive bomb body and a fairly inefficient bomb because the onboard explosive mass is then less than half the volume possible with a normal steel bomb body.

One purpose of the invention is particularly to enable a bomb with a relatively low structural mechanical strength to pass through increasingly thick or strong walls.

To achieve this, the purpose of the invention is a penetrating projectile including:

- an inner tube inside which a perforating projectile is placed comprising at least one body provided with a pyrotechnic charge and a propulsion body, the body of the perforating projectile being ejected outside the tube by firing the propulsion body;
- a system for controlling firing of the propulsion body, before the impact of the penetrating projectile on a target.

For example, the perforating projectile comprises a system that determines its position inside the target as a function of time and that triggers detonation of its pyrotechnic charge at a predetermined instant. For example, this system determines the position of the perforator starting from its deceleration level characteristics in the material from which the target is made and its velocity at the point of impact on the target.

Advantageously, the inner tube includes at least two sections with different calibres, the section with the smallest calibre being oriented towards the output from the tube, the body of the perforating projectile being adapted to the output calibre of the tube, the propulsion body jamming at the transition between the two sections during ejection of the body of the perforating projectile. For example, the transition between the two sections is in the form of a cone such that the casing of the propulsion body is welded onto the cone by friction.

The body of the perforating projectile may be fixed to the casing of the propulsion body by pins.

In particular, the projectile comprises a pyrotechnic charge placed between its body and the tube containing the perforating projectile.

Another purpose of the invention is a method for penetration of a projectile according to the previous characteristics, inside a target, particularly a concrete wall. According to this method:

- the perforating projectile is ejected from the tube by firing its propulsion body when the projectile is at a given distance d from the target;
- since the perforating projectile penetrates into the target before the projectile, the perforating projectile detonates inside the target by firing its pyrotechnic charge to create an orifice through which the body of the projectile can pass.

Advantageously, the perforating projectile detonates for example in the centre of the target.

SUMMARY OF THE INVENTION

The main purpose of the invention is that it can have the same volume, mass and velocity as existing solutions, and is capable of increasing the range of angle of incidence on arrival of the body of a bomb onto a wall, and that it can increase the onboard explosive charge.

BRIEF DESCRIPTION OF THE DRAWINGS

Other characteristics and advantages of the invention will become clearer after reading the following description with reference to the appended figures, wherein.

DETAILED DESCRIPTION OF THE DRAWINGS

Figure 1:
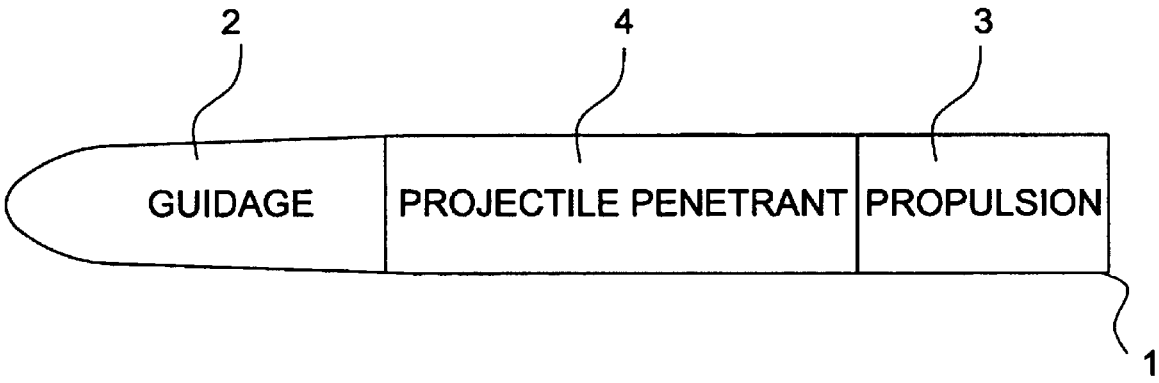
FIG. 1 is an example of a rocket structure.

FIG. 1 shows the structure of a rocket 1. As mentioned above, it is composed essentially of three parts 2, 3 and 4. The front part of the rocket comprises guide means 2 and the back part comprises propulsion means 3. The penetrating projectile 4, for example a warhead such as a bomb, is located between the guide means and the propulsion means. The fact that the casing of the rocket and the global mass are fixed, means that the volume and mass dedicated to the penetrating projectile 4 are also fixed, because it is hardly possible to reduce the parts set aside for the guide means and propulsion means. Therefore the structural mechanical strength of the penetrating body cannot be increased significantly. Similarly, the velocity of the penetrating body is fixed by the velocity of the rocket 1.

Figure 2:
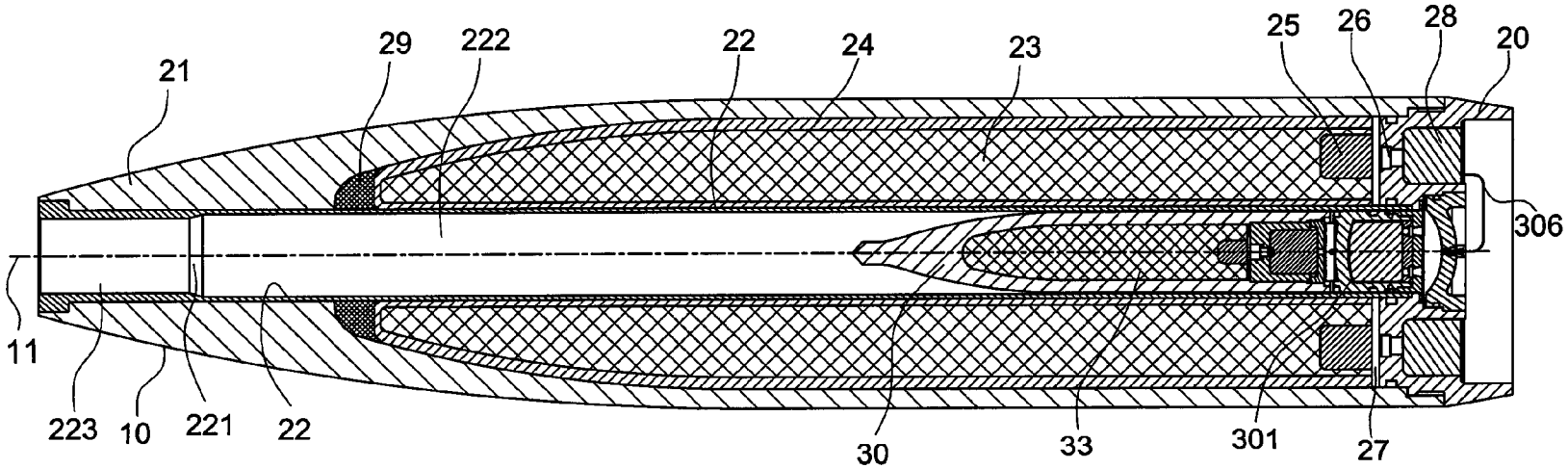
FIG. 2 is one possible example embodiment of a projectile according to the invention.

FIG. 2 is a cross-sectional view showing an example embodiment of a projectile according to the invention. For the remainder of the description, it will be assumed that the projectile is a bomb. Therefore, FIG. 2 shows a bomb 10 that can be contained in the space allocated to the penetrating body 4 in the rocket in FIG. 1, while having high penetration performances. The bomb comprises a body 21 inside which a tube 22 is placed. For example, the tube 22 comprises a jamming cone 221 forming the transition between a first tube section 222 and an output section 223 with a smaller calibre facing the front of the bomb body.

Since the bomb body 21 has a symmetry of revolution, the axis 11 of the tube 22 is for example coincident with the centre line of the body 21. The pyrotechnic charge 23 is placed inside the bomb body 21 around the tube 22. The charge 23 is contained inside a duct 24 placed between the inner face of the bomb body 21 and the tube 22. A primer relay 25, for example toroidal, located inside the pyrotechnic charge 23 is capable of igniting this pyrotechnic charge. The back of the pyrotechnic charge 23 is closed by a wall 27 occupying the space between the inner face of the bomb body and the tube. A base 20 closes off the back of the bomb body 21. A striker 26 is placed in the base facing the primer relay 25, through the wall 27. The striker 26 is controlled by an electronic 28, for example toroidal in shape, also contained in the base 20. A shock attenuator 29 is placed in front of the pyrotechnic charge, jammed between the duct 24 and the inside of the bomb body 21.

A hyperfast perforating projectile 30 containing the pyrotechnic charge is placed inside the tube. In particular, this perforator creates a duct through a wall to be passed through, in advance. To achieve this, the perforator exits from the tube when approaching the wall by means of its own propulsion means, at a velocity significantly higher than the velocity of the body of the bomb 21. It then detonates once it has entered inside the wall.

Figure 3:
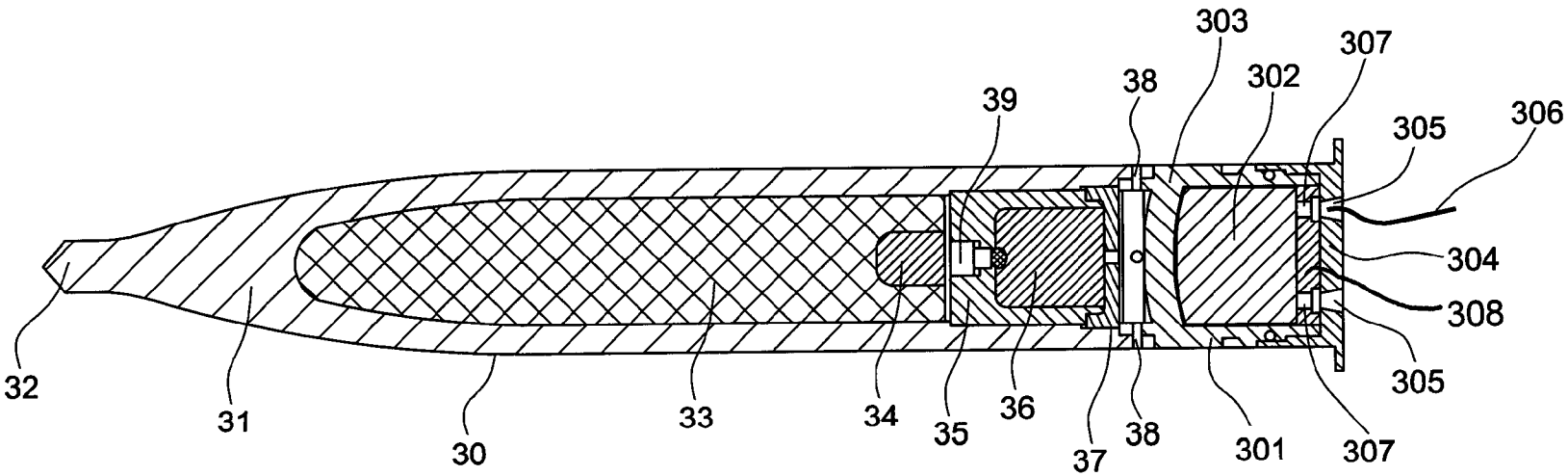
FIG. 3 is an example embodiment of a perforating projectile contained inside the previous projectile.

FIG. 3 is a cross-section through one possible embodiment of the perforating projectile 30. This projectile comprises a body 31. For example, this body may have a tip 32 at the front to facilitate penetration. A pyrotechnic charge 33 is located inside the body. A primer relay 34 is placed inside the charge 33. A support 35 closes the space behind the pyrotechnic charge 33. This support 35 comprises a striker 39 facing the primer relay 34 for priming by percussion that causes firing of the pyrotechnic charge 33. The striker 39 is controlled by an electronic module 36 also placed in the support 35. A cover 37 closes off the back of the body. A propulsion body 301 is placed behind the body of the projectile 31. This propulsion body 301 is fixed to the body of the projectile by means of pins 38. To achieve this, the outside wall of the propulsion body 301 is prolonged inside part of the wall of the projectile body itself extending beyond the cover 37. The pins pass through the two walls facing each other through holes provided for this purpose. The propulsion body comprises a pyrotechnic charge 302 inside its casing 303. For example, this charge 302 is composed of plastic modules. A plug 304 closes off the back of the propulsion body. For example, the plug 304 is screwed onto the casing 303 of the propulsion body. One or several closers 305 are drilled in the plug to allow a control link 306 to pass through. This link may for example be connected to an ignition chip 307 placed in contact with the pyrotechnic charge 302. Packing means 308 may for example be placed between the plug 304 and the charge in the propulsion body 302.

Firing of the propulsion body 301 causes ejection of the perforating projectile 30 outside the tube of the body 31.

Figure 4:
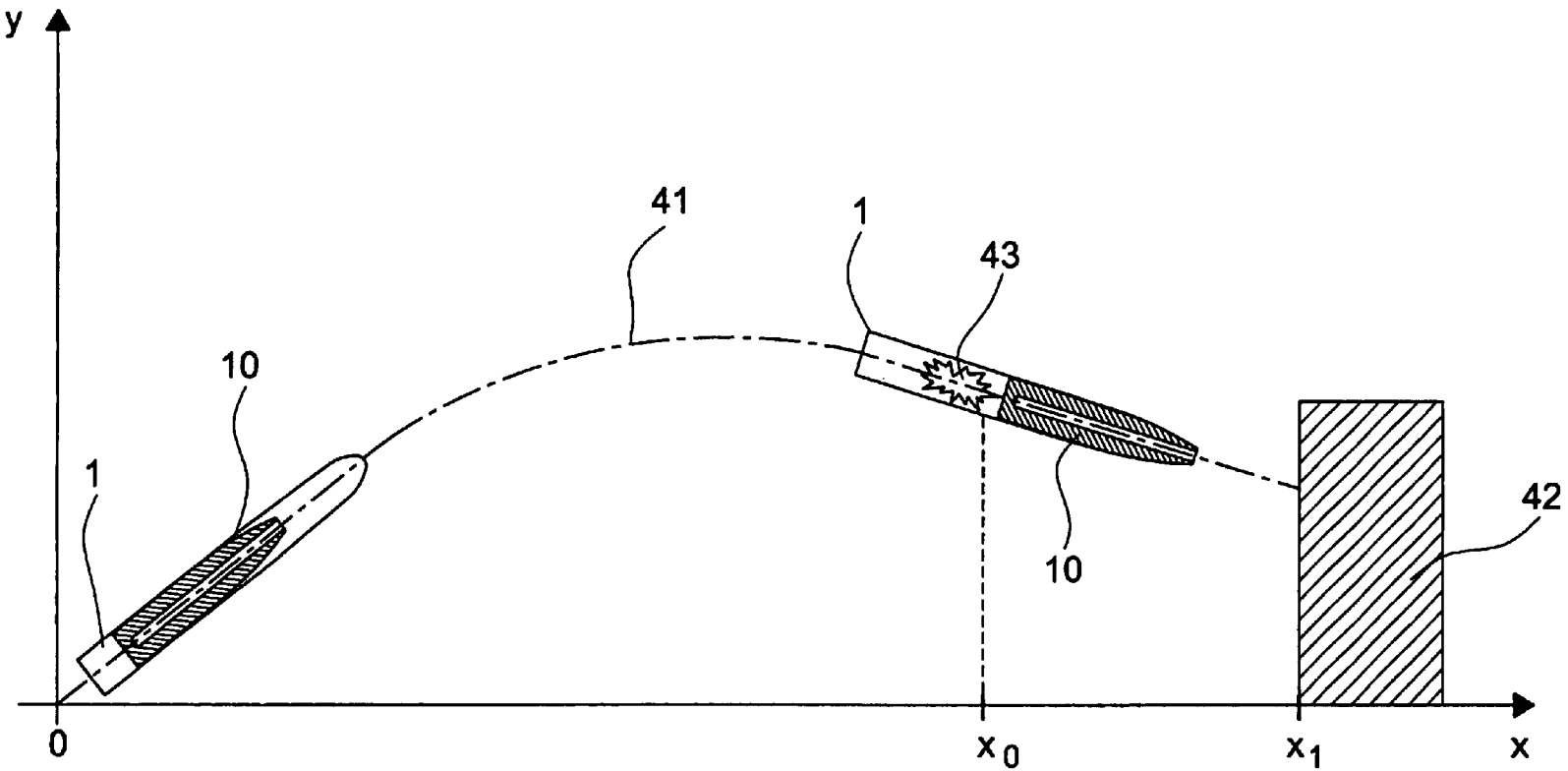
FIG. 4 shows the location of the rocket containing a projectile according to the invention, when the rocket is launched and when the projectile is ejected from the rocket.

FIG. 4 shows the rocket 1 in two locations on its trajectory 41 towards a concrete wall 42 in a system with axes x, y. The positions from the ground are indicated on an abscissa axis x. The ordinate axis y represents the altitude of the rocket. In order to facilitate the representation, the scales of the distances and altitudes are smaller than the scales at which the rocket and the slab are shown. In the start position, at abscissa position 0, the rocket together with its bomb 10 is placed ready for launching. The concrete wall is located at a distance $x_1$ from the start position. The rocket is propelled by its propulsion means 3 at the back. At a distance $x_0$ less than $x_1$ the bomb is separated from the rocket. For example, the distance $x_1$-$x_0$ may be of the order of 20 meters. Separation 43 takes place by internal firing, the bomb 10 then being ejected from the rocket. The position of the rocket from the wall 42 may for example be determined by a proximity sensor at the front of the rocket with guide means.

FIGS. 5*a* to 5*f* illustrate the method according to the invention, presenting the different phases of a bomb according to the invention in the approach phase and the phase passing through the wall 42.

Figures 5A, 5B, 5C, 5D, 5E, 5F:
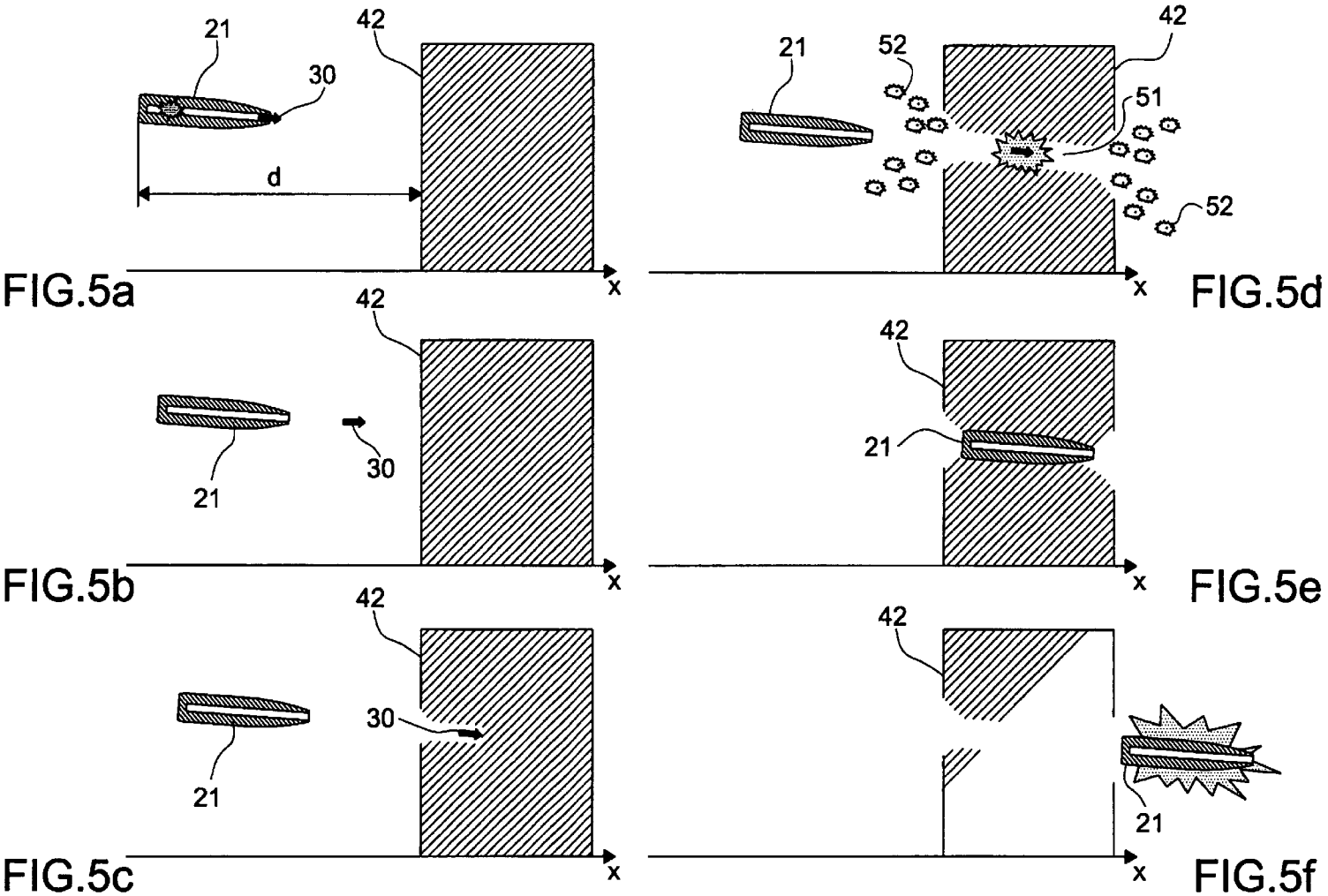
FIGS. 5*a* to 5*f* show an illustration of the penetration method according to the invention.

FIG. 5*a* shows the firing time of the charge 302 of the propulsion body of the perforator 30 when in the immediate vicinity of the target, namely the wall 42. At this moment, the bomb is at a distance less than the distance $x_1$-$x_0$. This distance d may for example be of the order of 10 meters. The distances $x_1$-$x_0$ and d may be approximately the same. Therefore at the firing time, the perforator 30 is ejected from the bomb body 21 at a very high speed relative to this body. For example, if the bomb moves at a velocity of the order of 300 m/s, the perforator can exit with a relative velocity of the same order. The result will be an absolute velocity with respect to the wall, for example of the order of 600 to 700 m/s. Several solutions are possible to determine the priming time of the propulsion body of the perforator 30, in other words the ejection time of the perforator from the bomb body 21. A timer, for example placed in the electronic module 28 of the bomb body, may for example calculate a time between the instant of ejection of the rocket bomb body and the priming instant of the propulsion body of the perforator, the ejection time from the bomb body being determined for example by guide means 2 located in front of the rocket 1. Knowing the velocity of the bomb body and the distance $x_1$-$x_0$ from the bomb body to the wall at the priming time, it is possible to determine the timing duration necessary so that the ejection of the perforator takes place at approximately the required distance from the wall. For example, the electronic module 28 on the propulsion body of the perforator may be controlled using an electric link 306. For example, an electrical signal activates the ignition chip 307 that triggers firing of the pyrotechnic charge 302.

FIG. 5*b* shows the flight of the perforator 30 as far as the wall 42, followed by the bomb body 21. The ignition chip 307, the electrical link 306 and the electronic bloc make up a system for controlling firing of the propulsion body 301 before the impact of the bomb 10 on a target, the wall 42 in the example in FIGS. 5*a* to 5*f*. Another type of system could be used.

FIG. 5*c* shows penetration of the perforator 30 into the wall 42. The relative velocity of the perforator with respect to the bomb body enables it to impact the wall 42 first.

FIG. 5*d* shows detonation of the perforator 30 inside the wall, preferably in the middle, creating an orifice 51 passing through the wall 42. This is done by providing the perforator with a system that determines its position inside the wall as a function of time and that triggers detonation of its pyrotechnic charge at a predetermined instant. For example, this system is contained in the electronic module 36. Detonation is provoked by firing of the pyrotechnic charge 33.

The invention advantageously uses the fact that concretes cannot resist tension stresses. Therefore, this means that concrete can be relatively easily destructured by detonation of the perforator within the wall, this internal detonation creating high tension stresses. An internal processor located in the electronic module 36 of the perforator can determine the detonation instant of the perforator corresponding to its most effective position inside the wall, for example in the middle of the wall. This is done by memorising a table in the processor. This table contains characteristics of deceleration levels of an object penetrating into a material. It may take account of several types of materials, obviously including concrete and even different types of concrete. Thus knowing the initial velocity of the perforator 30 on entry into the wall at the point of impact, and the deceleration curve of the material of this wall, the resulting penetration distance inside the wall and therefore its position can be determined. For example, a "caiman" type impact intelligence module can be used.

FIG. 5*e* presents penetration of the bomb body 21 into the orifice 51 created by the perforator. Detonation of the perforator 30, for example in the middle of the wall 42, creates this orifice 51. The quantity of charge transported by the perforator 30 may be calculated to obtain an orifice adapted to the calibre of the bomb body 21, in other words in practice close to the calibre of the bomb body. The invention can thus considerably reduce stresses applied to the bomb body during its penetration phase into the wall and consequently can enable a bomb with a relatively low structural mechanical strength to pass through increasingly thicker and strong walls. In reducing the strength of the mechanical structure of the bomb body, it becomes possible to increase the onboard explosive mass, hence providing a greater destruction capacity after passing through the wall. Thus, the onboard explosive mass can be increased by about 20%, which results in a mass and brightness velocity being about 15% higher.

FIG. 5*f* shows the bomb body 21 after passing through the wall 42. At this moment, the bomb body may for example detonate by firing its pyrotechnic charge 23.

Figure 6:
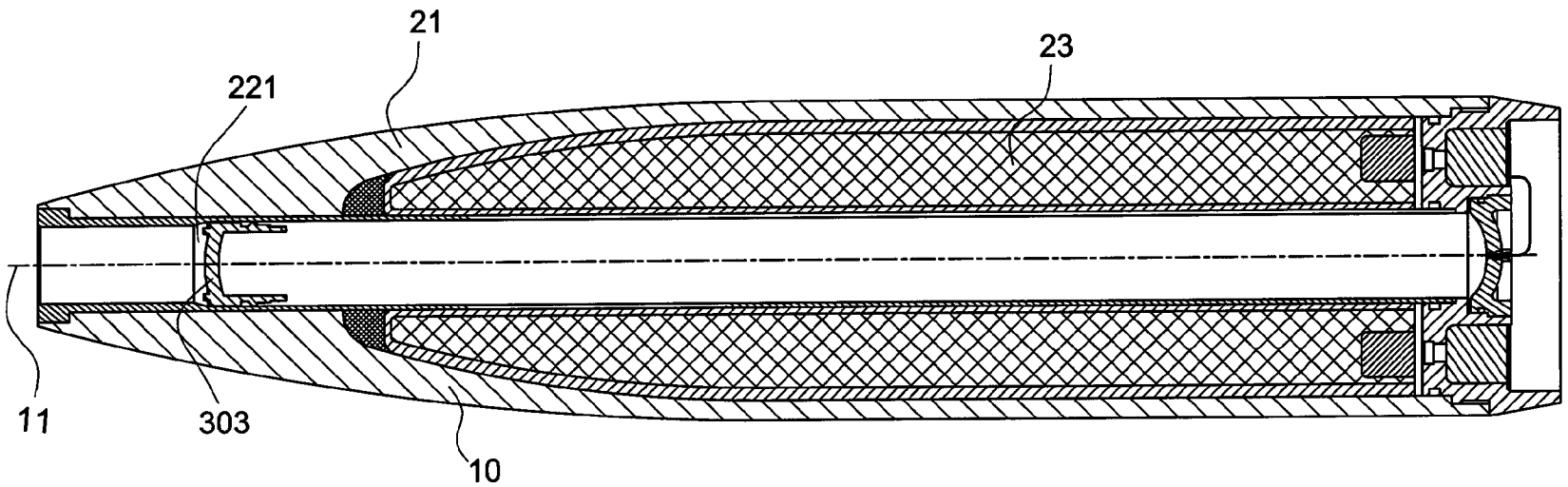
FIG. 6 shows the propulsion body of the perforating projectile jammed at the exit from the projectile preventing debris from penetrating inside.

FIG. 6 shows an advantage provided by the jamming cone 221 of the inner tube in the bomb body. More particularly, FIG. 6 shows how the propulsion body of the perforator 30 is held in place, and particularly the casing 303 of the propulsion body 301, in the tube by jamming it at the jamming cone 221. The casing 303, the diameter of which is greater than the calibre of the tube exit section under the effect of its velocity, is welded by friction onto the jamming cone internal to the tube. This prevents any potential ingress of gravel into the bomb body. The propulsion body is held in place reinforced by confinement of all propulsion gases within the tube. The casing 303 remains welded to the tube while the body 31 of the perforator, adapted to the output calibre of the tube 22, is ejected from the tube. The body 31 of the perforator is detached from the casing 303 of the propulsion body by shearing of the pins 38 that fix the two bodies to each other.

Therefore, the casing of the propulsion body advantageously forms a protection wall. As has just been explained above, it thus prevents any intrusion of rubble or debris 52 inside the bomb body during the penetration phase of the bomb body into the wall. Such debris, particularly generated during detonation of the perforator 30 inside the wall as shown in FIG. 5*e*, could provoke parasite explosions.

Furthermore, the resistance of the wall to external intrusions, in addition to the effect of friction welding, is reinforced by the internal pressure generated by combustion gases in the tube 22. In other words, the seal function provided to the propulsion body keeps combustion gases within the tube, which will reinforce the strength of the weld due to their thrust.

Figure 7:
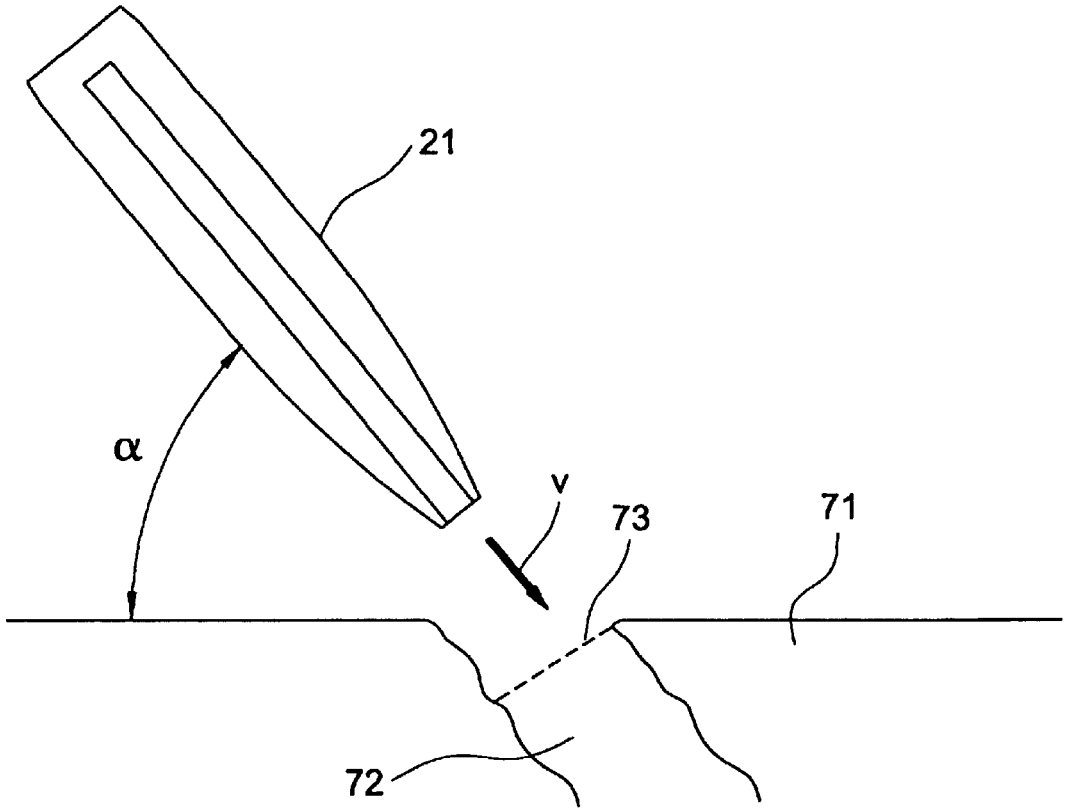
FIG. 7 is an illustration of the wide range of the angle of incidence of a projectile according to the invention onto a wall.

FIG. 7 shows another advantage of the invention. In particular, this figure shows that the invention can increase the range of the angle of incidence of the arrival of the bomb body 21 on a wall 71. The orifice 72 created by the perforator in the wall 71 itself creates an input face 73 normal to the velocity vector V of the bomb body. In particular, this input face 73 prevents ricochets of the bomb body onto the wall when the angle of incidence $\alpha$ of its velocity vector on the wall is too low. If this angle $\alpha$ is still too low, incidence will still occur. The perforator 30 that is thinner and faster than the bomb body can penetrate the wall even at low angles of incidence, the bomb body benefiting from the orifice created by the perforator and consequently having a wider incidence range.

The invention was described to make a penetration bomb inside an infrastructure. However, it may be applicable to other types of projectiles designed to penetrate into an infrastructure by passing through a thick wall. In particular, the invention makes it possible to pass through concrete walls with a high modulus of rupture in compression equal for example to up to 200 MPa.

The invention claimed is:

1. A penetrating projectile, comprising:

a body;

an inner tube including a perforating projectile inside the inner tube, wherein said perforating projectile includes a body having a pyrotechnic charge; and at least one propulsion body that is entirely arranged behind the body of said perforating projectile, the body of the perforating projectile being ejectable outside the inner tube by firing said propulsion body;

a system for controlling firing of the propulsion body before the impact of the penetrating projectile on a target; and a pyrotechnic charge placed between the body of the penetrating projectile and the inner tube, wherein the inner tube includes at least two sections with different calibres, one of the sections with the smallest calibre being oriented towards the output from the tube, the body of the perforating projectile being adapted to the output calibre of the tube, the propulsion body jamming at the transition between the two sections during ejection of the body of the perforating projectile.

2. The projectile according to claim 1, wherein the perforating projectile comprises a system configured to determine a position of the perforating projectile inside the target as a function of time, and to trigger detonation of the pyrotechnic charge of the perforating projectile at a predetermined instant.

3. The projectile according to claim 2, wherein the system of the perforating projectile is configured to determine the position of the perforating projectile starting from a deceleration level characteristics in the material from which the target is made and a velocity at the point of impact on the target.

4. The projectile according to claim 2, wherein the perforating projectile comprises an electronic module including the system that is configured to determine the position of the perforating projectile inside the target, the electronic module also controlling priming of the pyrotechnic charge.

5. The projectile according to claim 4, wherein the electronic module of the perforating projectile is placed on the support.

6. The projectile according to claim 1, wherein the body of the perforating projectile is fixed to the propulsion body by pins, and the propulsion body includes a pyrotechnic charge thereby the propulsion body is adapted to be fired and the perforating projectile is adapted to be ejected outside the inner tube.

7. The projectile according to claim 1, wherein a primer relay is located inside the pyrotechnic charge of the perforating projectile.

8. The projectile according to claim 7, wherein the perforating projectile comprises a support closing the space behind the pyrotechnic charge of the perforating projectile, said support including a striker facing the primer relay.

9. The projectile according to claim 1, wherein the system for controlling firing of the propulsion body of the perforating projectile comprises an electronic module and at least an ignition chip, an electric signal being sent from the electronic module to the ignition chip through an electrical link.

10. The projectile according to claim 9, wherein the electronic module is toroidal in shape and is placed inside a base closing the body of the projectile.

11. The projectile according to claim 1, wherein said body of the penetration projectile has a symmetry of revolution and has an axis that is coincident with a center line of the inner tube.

12. A method for penetration of a penetrating projectile according to claim 1 inside a target, wherein the perforating projectile is ejected from the tube by firing the propulsion body when the projectile is at a given distance d from the target; and since the perforating projectile penetrates into the target before the projectile, the perforating projectile detonates inside the target by firing the pyrotechnic charge to create an orifice through which the body of the penetrating projectile passes.

13. The method according to claim 12, wherein the perforating projectile detonates in a center of the target.

14. The method according to claim 12, wherein the target is a concrete wall.

15. A penetrating projectile, comprising:

a body;

an inner tube inside which a perforating projectile is placed, said perforating projectile comprising at least one body provided with a pyrotechnic charge, the body of the perforating projectile being ejected outside the inner tube by firing a propulsion body formed behind the body of the perforating projectile;

a system for controlling firing of the propulsion body before the impact of the penetrating projectile on a target; and a pyrotechnic charge placed between the body of the penetrating projectile and the inner tube, wherein the inner tube includes at least two sections with different calibres, one of the sections with the smallest calibre being oriented towards the output from the tube, the body of the perforating projectile being adapted to the output calibre of the tube, the propulsion body jamming at the transition between the two sections during ejection of the body of the perforating projectile.

16. The projectile according to claim 15, wherein the transition between the two sections is in the form of a cone such that the casing of the propulsion body is welded onto the cone by friction.

* * * * *